US008710337B1

(12) United States Patent
Gomes

(10) Patent No.: US 8,710,337 B1
(45) Date of Patent: Apr. 29, 2014

(54) TONE ENHANCEMENT BRACKET

(76) Inventor: Fernando R. Gomes, Myrtle Beach, SC (US)

( * ) Notice: Subject to any disclaimer, the term of this patent is extended or adjusted under 35 U.S.C. 154(b) by 230 days.

(21) Appl. No.: 13/303,991

(22) Filed: Nov. 23, 2011

Related U.S. Application Data

(60) Provisional application No. 61/319,448, filed on Mar. 31, 2010.

(51) Int. Cl.
*G10D 3/02* (2006.01)

(52) U.S. Cl.
USPC ..... 84/294

(58) Field of Classification Search
USPC ..... 84/267, 290, 291
See application file for complete search history.

(56) References Cited

U.S. PATENT DOCUMENTS

| | | | |
|---|---|---|---|
| 410,670 | A | 9/1889 | Jenney |
| 579,498 | A | 3/1897 | Schreiber |
| 1,679,290 | A | 7/1928 | Bessier |
| 1,872,633 | A | 8/1932 | Rudolph |
| 1,913,233 | A | 6/1933 | De Francesco |
| 2,001,723 | A | 5/1935 | Hammond, Jr. |
| 2,092,768 | A | 9/1937 | Mansell |
| 2,205,804 | A | 6/1940 | Winston |
| 2,952,179 | A | 9/1960 | Andersen |
| 2,953,052 | A | 9/1960 | Newton |
| 2,972,923 | A | 2/1961 | Fender |
| 3,072,007 | A | 1/1963 | Burke |
| 3,130,625 | A | 4/1964 | Savona |
| D203,481 | S | 1/1966 | Wiggins |
| 3,251,257 | A | 5/1966 | Bunker |
| 3,375,747 | A | 4/1968 | Posey |
| 3,396,621 | A | 8/1968 | Dycus |
| 3,413,883 | A | 12/1968 | Helbourne |
| 3,427,915 | A | 2/1969 | Mooney |
| 3,453,063 | A | 7/1969 | Lewis |
| D223,290 | S | 4/1972 | Wolfe |
| 3,657,462 | A | 4/1972 | Robinson |
| 3,718,747 | A | 2/1973 | Martin et al. |
| 3,742,114 | A | 6/1973 | Barkan |
| 3,743,751 | A | 7/1973 | Ibanez |
| 3,771,408 | A | 11/1973 | Wright |
| 3,878,748 | A | 4/1975 | Spence |
| 4,004,485 | A | 1/1977 | Hiscott |
| 4,088,050 | A | 5/1978 | Appel |
| 4,188,850 | A | 2/1980 | Kaman, II |
| 4,192,213 | A | 3/1980 | Steinberger |
| 4,201,108 | A | 5/1980 | Bunker |

(Continued)

FOREIGN PATENT DOCUMENTS

| | | |
|---|---|---|
| DE | 195 40 668 A1 | 5/1997 |
| GB | 2037049 | 7/1980 |
| JP | 7-129178 | 5/1995 |
| JP | 2000-267668 | 9/2000 |

*Primary Examiner* — Kimberly Lockett
(74) *Attorney, Agent, or Firm* — P. Jeff Martin; The Law Firm of P. Jeff Martin, LLC

(57) ABSTRACT

A tone enhancement bracket retrofitted to a guitar. The bracket includes an upper plate, a lower plate, and at least one cylinder mounted therebetween. The bracket may be installed in plurality to the body of a guitar. Once installed, the bracket or brackets increase the velocity of sound produced by the guitar, thereby enhancing and improving the tonal effects thereof. The bracket also allows the retrofitted guitar to produce notes possessing a higher degree of clarity, definition, and sustenance with respect to the pre-retrofitted guitar.

14 Claims, 6 Drawing Sheets

(56) References Cited

U.S. PATENT DOCUMENTS

| | | | | | |
|---|---|---|---|---|---|
| D256,251 | S | | 8/1980 | Grimes | |
| 4,230,013 | A | | 10/1980 | Wellings | |
| 4,254,683 | A | | 3/1981 | Nulman | |
| 4,290,336 | A | | 9/1981 | Peavey | |
| 4,295,403 | A | | 10/1981 | Harris | |
| 4,339,979 | A | | 7/1982 | Norman | |
| 4,359,923 | A | | 11/1982 | Brunet | |
| D267,329 | S | | 12/1982 | Cooper | |
| 4,411,186 | A | | 10/1983 | Faivre | |
| 4,450,748 | A | | 5/1984 | Shaw et al. | |
| 4,464,967 | A | | 8/1984 | Trimborn | |
| 4,539,866 | A | | 9/1985 | Koivunen | |
| 4,539,886 | A | | 9/1985 | Hoffart | |
| 4,686,882 | A | * | 8/1987 | Shaw | 84/291 |
| 4,697,491 | A | | 10/1987 | Maloney | |
| 4,750,400 | A | | 6/1988 | Milne | |
| 4,785,705 | A | | 11/1988 | Patterson | |
| 4,823,668 | A | | 4/1989 | Marrs | |
| 4,867,028 | A | | 9/1989 | Jones | |
| 4,890,529 | A | | 1/1990 | Grant | |
| 4,890,530 | A | | 1/1990 | Tatsumi | |
| 4,903,567 | A | | 2/1990 | Justus | |
| 4,919,031 | A | | 4/1990 | Matsumoto | |
| D310,091 | S | | 8/1990 | Tatsumi | |
| 5,052,269 | A | | 10/1991 | Young, Jr. | |
| 5,054,356 | A | | 10/1991 | Farnell, Jr. | |
| 5,056,400 | A | | 10/1991 | Wachi | |
| 5,105,711 | A | | 4/1992 | Barnard | |
| 5,121,668 | A | | 6/1992 | Segan et al. | |
| 5,212,329 | A | | 5/1993 | Woodworth | |
| D338,221 | S | | 8/1993 | Beliger | |
| 5,315,910 | A | | 5/1994 | Soupios | |
| 5,347,904 | A | | 9/1994 | Lawrence | |
| 5,403,972 | A | | 4/1995 | Valentine, Sr. | |
| 5,434,350 | A | | 7/1995 | Haney et al. | |
| 5,461,193 | A | | 10/1995 | Schertler | |
| 5,682,003 | A | | 10/1997 | Jarowsky | |
| 5,854,435 | A | | 12/1998 | Kim | |
| 5,889,221 | A | * | 3/1999 | Dejima | 84/291 |
| 5,895,872 | A | | 4/1999 | Chase | |
| 5,900,573 | A | | 5/1999 | Barnes | |
| 5,911,168 | A | | 6/1999 | Enserink | |
| 5,929,362 | A | | 7/1999 | Oteyza | |
| 5,990,397 | A | | 11/1999 | Taylor | |
| 5,994,633 | A | | 11/1999 | Norton | |
| 6,031,176 | A | | 2/2000 | Tanaka | |
| 6,188,005 | B1 | | 2/2001 | White | |
| 6,255,565 | B1 | | 7/2001 | Tamura | |
| 6,369,304 | B1 | | 4/2002 | Tucker | |
| 6,441,293 | B1 | | 8/2002 | Labarbera | |
| 6,525,246 | B1 | | 2/2003 | Erismann | |
| 6,646,190 | B2 | | 11/2003 | Brown | |
| 6,696,632 | B2 | | 2/2004 | Minakuchi et al. | |
| 6,800,797 | B2 | | 10/2004 | Steiger, III | |
| 6,809,245 | B2 | | 10/2004 | Sawhney et al. | |
| D499,756 | S | | 12/2004 | Di Pinto | |
| D499,757 | S | | 12/2004 | Hoffman | |
| 7,754,951 | B2 | | 7/2010 | Thornhill | |
| 7,888,573 | B1 | | 2/2011 | Darbon | |

* cited by examiner

TONE ENHANCEMENT BRACKET

RELATED APPLICATIONS

This application was initially disclosed in U.S. Provisional Application No. 61/319,448 filed on Mar. 31, 2010.

BACKGROUND OF THE INVENTION

1. Field of the Invention

The present invention relates generally to musical instruments and accessories therefor, and more particularly, to a bracket adapted to be mounted to a guitar to increase the velocity of sound produced thereby.

2. Description of the Related Art

Currently there exist in the art various stringed instruments modified in size and/or via components, e.g., soundboards and electric pickups, for purposes of generating amplified sound. However, the prior art has failed to disclose or teach a retro-mountable bracket for a guitar, the bracket includes an upper plate, a lower plate, and at least one cylinder securably mounted therebetween, wherein the bracket being adapted and configured to increase the velocity of sound produced by the guitar, as taught by the present application.

Accordingly, a need exists for a retro-mountable bracket for a guitar designed and configured to increase the velocity of sound produced by the guitar installed with said bracket, thereby enhancing and improving the tonal effects thereof. The development of the tone enhancement bracket fulfills this need.

A search of the prior art did not disclose any patents that read directly on the claims of the instant invention; however, the following references were considered related:

U.S. Pat. No. 4,411,186;
U.S. Pat. No. 3,375,747;
U.S. Pat. No. 6,188,005;
U.S. Pat. No. 3,743,751;
U.S. Pat. No. 5,682,003;
U.S. Pat. No. 4,867,028;
U.S. Pat. No. 6,646,190;
U.S. Pat. No. 5,105,711;
U.S. Pat. No. 4,230,013;
U.S. Pat. No. 5,121,668;
U.S. Pat. No. 6,525,246 B1;
U.S. Pat. No. 5,403,972;
U.S. Pat. No. 5,461,193;
U.S. Pat. No. 5,434,350;
U.S. Pat. No. 5,900,573;
U.S. Pat. No. 4,290,336;
U.S. Pat. No. 5,929,362;
U.S. Pat. No. 5,990,397;
U.S. Pat. No. 5,895,872;
U.S. Pat. No. 6,031,176;
U.S. Pat. No. 5,911,168;
U.S. Pat. No. 6,255,565 B1;
U.S. Pat. No. 4,088,050;
U.S. Pat. No. 6,369,304 B1;
U.S. Pat. No. 6,809,245 B2;
U.S. Pat. No. 6,441,293 B1;
U.S. Pat. No. 6,800,797 B2;
U.S. Pat. No. 6,696,632 B2;
U.S. Pat. No. 5,056,400;
U.S. Pat. No. 5,854,435;
U.S. Pat. No. 6,441,293 B1;
U.S. Pat. No. 2,953,052;
U.S. Pat. No. 2,972,923;
U.S. Pat. No. 3,072,007;
U.S. Pat. No. 4,359,923;
U.S. Pat. No. 4,539,866;
U.S. Pat. No. 5,052,269;
U.S. Pat. No. D203,481;
U.S. Pat. No. D223,290;
U.S. Pat. No. D267,329;
U.S. Pat. No. D338,221;
U.S. Pat. No. 579,498;
U.S. Pat. No. 2,952,179;
U.S. Pat. No. 1,679,290;
U.S. Pat. No. 3,718,747;
U.S. Pat. No. 2,001,723;
U.S. Pat. No. 3,878,748;
U.S. Pat. No. 2,205,804;
U.S. Pat. No. 4,464,967;
U.S. Pat. No. 4,697,491;
U.S. Pat. No. 4,750,400;
U.S. Pat. No. 5,054,356;
U.S. Pat. No. 3,427,915;
U.S. Pat. No. 4,890,529;
U.S. Pat. No. 4,823,668;
U.S. Pat. No. 1,913,233;
U.S. Pat. No. 4,539,886;
U.S. Pat. No. 2,092,768;
U.S. Pat. No. 4,450,748;
U.S. Pat. No. 4,088,050;
U.S. Pat. No. 4,188,850;
U.S. Pat. No. 4,359,923;
U.S. Pat. No. 4,201,108;
U.S. Pat. No. 3,251,257;
U.S. Pat. No. 3,396,621;
U.S. Pat. No. 3,657,462;
U.S. Pat. No. 4,004,485;
U.S. Pat. No. 2,953,052;
U.S. Pat. No. D499,757 S;
U.S. Pat. No. D256,251;
U.S. Pat. No. 410,670;
U.S. Pat. No. D499,756 S;
U.S. Pat. No. D310,091;
U.S. Pat. No. 4,890,530;
U.S. Pat. No. 4,192,213;
U.S. Pat. No. 3,072,007;
U.S. Pat. No. 3,413,883;
U.S. Pat. No. 3,453,063;
U.S. Pat. No. 3,771,408;
U.S. Pat. No. 7,754,951;
U.S. Pat. No. 4,339,979;
U.S. Pat. No. 7,888,573;
U.S. Pat. No. 4,903,567;
U.S. Pat. No. 6,188,005;
U.S. Pat. No. 1,872,633;
U.S. Pat. No. 3,130,625;
U.S. Pat. No. 4,785,705;
U.S. Pat. No. 3,251,257;
U.S. Pat. No. 5,315,910;
U.S. Pat. No. 5,212,329;
U.S. Pat. No. 5,994,633;
U.S. Pat. No. 4,254,683;
U.S. Pat. No. 4,295,403;
U.S. Pat. No. 5,347,904;
U.S. Pat. No. 4,539,886;
U.S. Pat. No. 4,919,031;
U.S. Pat. No. 3,742,114;
DE 195 40 668 A1;
JP 7-129178;
JP 2000-267668; and
GB 2037049.

Consequently, a need has been felt for a retro-mountable bracket for a guitar designed and configured to increase the velocity of sound produced by the guitar installed with said bracket, thereby enhancing and improving the tonal effects thereof.

This application presents claims and embodiments that fulfill a need or needs not yet satisfied by the products, inventions and methods previously or presently available. In particular, the claims and embodiments disclosed herein describe a bracket, preferably a pair of brackets, mounted to the body of a guitar, the bracket comprising an upper plate; a lower plate; and at least one cylinder securably mounted between the upper plate and lower plate in a generally upright or sloped orientation; the bracket being adapted and configured to increase the velocity of sound produced by a guitar, thereby enhancing and improving the tonal effects thereof, the bracket being further adapted and configured to facilitate the production of notes possessing a higher degree of clarity, definition, and sustenance, the bracket providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Briefly described according to one embodiment of the present invention, a tone enhancement bracket is disclosed for increasing the velocity of sound produced by a guitar, thereby enhancing and improving the tonal effects thereof. The bracket is further adapted and configured to facilitate the production of notes possessing a higher degree of clarity, definition, and sustenance. The bracket is installed, preferably as a pair, to the body of a guitar. However, while a pair of brackets is preferred, it is envisioned a plurality of brackets may also be installed to the body and other parts of a guitar. The bracket comprises an upper plate, a lower plate, and at least one cylinder securably mounted therebetween in a generally upright or sloped orientation. The upper plate and lower plate each define an elongated, planar configuration and having at least one hole defined therethrough, wherein the number of holes formed in each the upper plate and lower plate being equal to the number of cylinders. The upper plate and lower plate may each be constructed in any one of various geometric shapes. The upper plate and lower plate are envisioned to be commercially available in a variety of colors. The cylinders are also envisioned to be commercially available in a variety of colors.

In accordance to one embodiment of the present invention, in order to mount the bracket as a pair to the body of a guitar, a first posterior portion and a second posterior portion of the body of the guitar is separated or removed therefrom, leaving the guitar body with a central portion flanked by a first vertical end wall and a second vertical end wall.

The lower wall of the lower plate of one bracket of a pair of brackets is aligned-in line and engaged intimately against the first vertical end wall of the central portion of guitar body in a flush manner, and is securely mounted thereto. The lower wall of the lower plate of the second bracket of the pair of brackets is aligned-in line and engaged intimately against the second vertical end wall of the central portion of the guitar body in a flush manner, and is securely mounted thereto. Next, an inner vertical wall of the first posterior portion is aligned-in line and engaged intimately against the upper wall of the upper plate of the first bracket of the pair of brackets in a flush manner, and is securely mounted thereto. Thereafter, an inner vertical wall of the second posterior portion is aligned-in line and engaged intimately against the upper wall of the upper plate of the second bracket of the pair of brackets in a flush manner, and is securely mounted thereto.

Once the brackets are mounted to the body of a selected guitar, the brackets facilitate an increase in the velocity of the sound as it is transmitted from the body and through the brackets through which the frequency and vibration of the energy, produced by electric pickups and other electronics utilized, is modified. The brackets function to enhance and amplify tonal effects, in addition to facilitating the production of notes possessing a higher degree of clarity, definition, and sustenance.

It is envisioned that a pair of brackets comprising an unequal number of cylinders may be utilized for mounting to a guitar body.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
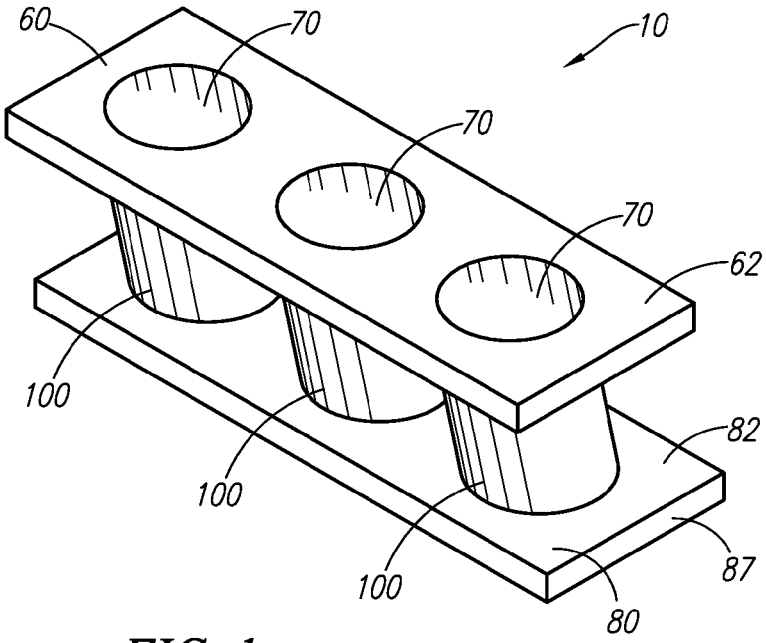
FIG. 1 is a top perspective view of a tone enhancement bracket, according to one embodiment of the present invention.
Figure 2:
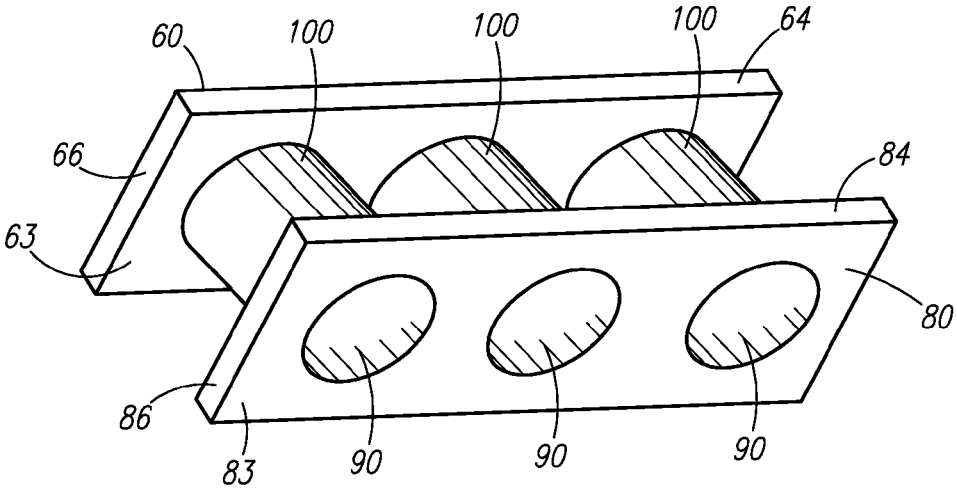
FIG. 2 is bottom perspective view of the bracket of FIG. 1.

Referring now to FIGS. 1-2, a tone enhancement bracket 10 is shown, according to one embodiment of the present invention. The tone enhancement bracket 10, hereinafter referred to as "bracket 10", is designed and configured to be installed, preferably as a pair, to the body 22 of a guitar 20. With regard to all such embodiments as may be herein described and contemplated, it will be appreciated that a plurality of brackets 10, including, but not limited to various shapes, sizes, colors, configurations, and materials thereof, may be utilized in association with the present invention, without departing from the spirit and scope of the invention.

The bracket 10 is adapted and configured to increase the velocity of sound produced by a guitar 20, thereby enhancing and improving the tonal effects thereof. The bracket 10 is further adapted and configured to facilitate the production of notes possessing a higher degree of clarity, definition, and sustenance. For purposes of this disclosure, velocity of sound refers to the speed at which a material transmits energy received thereby. The received energy is transmitted as vibrational energy. The bracket 10 facilitates an accelerated transmission of vibrational energy. While the guitar 20 body construction material is a significant factor concerning the sound or tonal properties produced by a guitar 20, many other factors substantially affect the sound as well. These factors include, but are not limited to the shape of the guitar body, and the number and variety of electromagnetic transducers (pickups) and electronics utilized, such as volume, tone and amplifier. Other relative factors include temperature and air pressure.

Figure 1A:
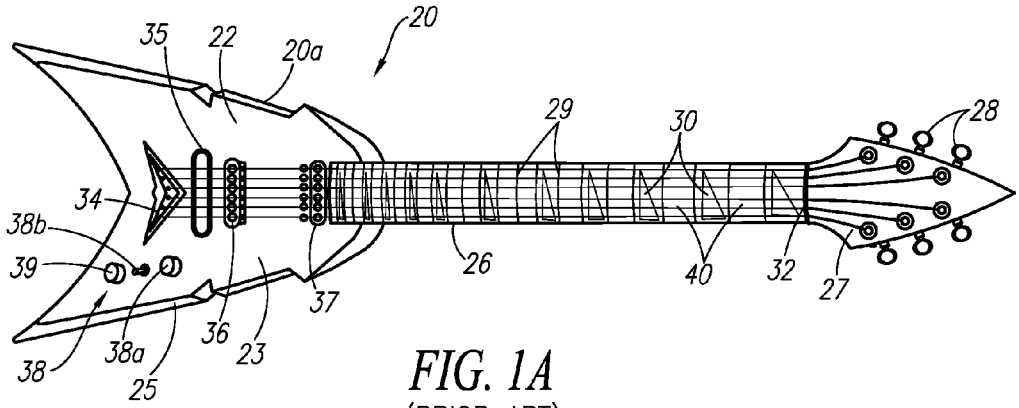
FIG. 1A (PRIOR ART)
FIG. 1A labeled as "Prior Art", illustrates a top perspective view of an electric guitar.
Figure 1B:
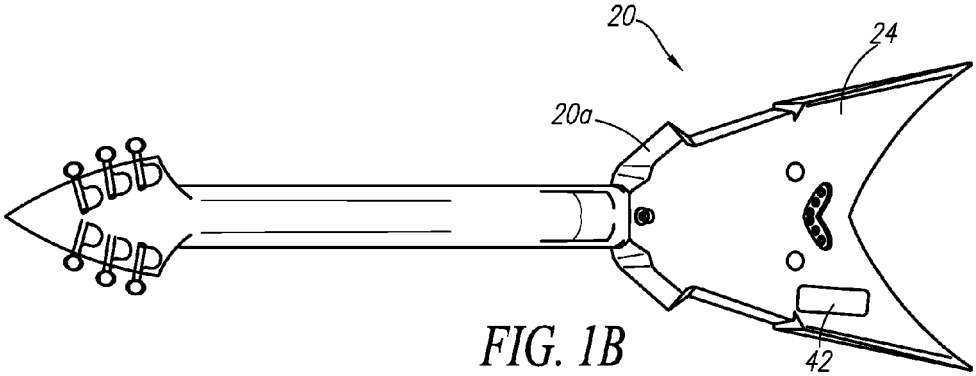
FIG. 1B (PRIOR ART)
FIG. 1B, labeled as "Prior Art", illustrates a bottom perspective view of the electric guitar of FIG. 1A.
Figure 1C:
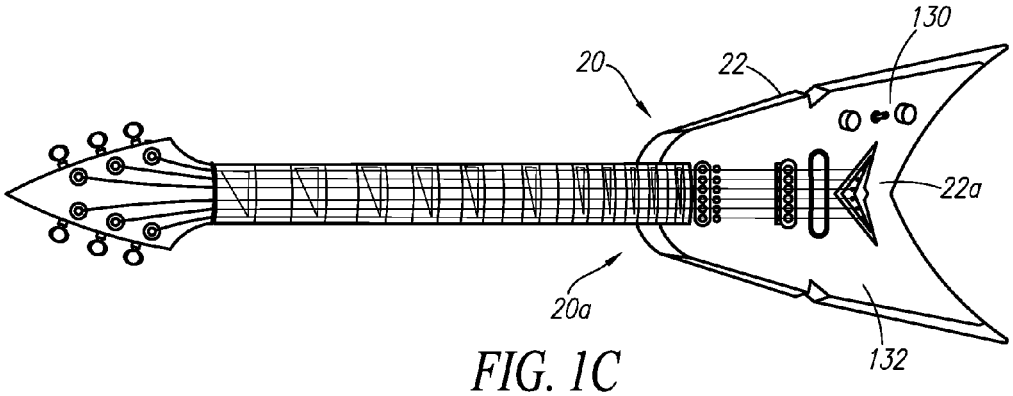
FIG. 1C (PRIOR ART)
FIG. 1C, labeled as "Prior Art", illustrates another top perspective view of an electric guitar.

For purposes of this disclosure, and in reference particularly to FIGS. 1A-1C, the body 22 of the guitar 20 has a top side 23 joined integrally to a bottom side 24 by a continuous peripheral sidewall 25. The body 22 may be defined as solid, semi-hollow, or hollow. The guitar 20 illustrated in FIGS. 1A-1C is an electric guitar 20*a* having a solid body 22. However, it is to be understood and appreciated that such instrument is illustrated herein for exemplary purposes, and that other string musical instruments embodying a substantially similar design, such as an electric bass, an acoustic guitar, an acoustic-electric guitar, bass acoustic, violin, and upright bass may be readily utilized for carrying out the several purposes of the claims presented in this application.

The body 22 includes a neck 26 extending therefrom which terminates into a head stock 27. The head stock 27 is mounted with a plurality of tuning pegs 28 to adjust the tension in the strings 40 of the guitar 20. The neck 26 includes frets 29, inlays 30, and a nut 32, wherein nut 32 is located below the head stock 27.

The body 22 of the guitar 20 further includes a bridge 34, a bridge pickup 35, a middle pickup 36, and a neck pickup 37, each of which being mounted atop the top side 23 of the body 22. The body 22 may include a plurality of electronic controls 38 and electrical inlet and/or outlet ports which include a volume knob 38*a*, at least one tone knob 39, a toggle switch 38*b*, and an output jack (not shown) recessed within a cavity formed in the bottom side 24 of body 22, the cavity having a cover 42 secured thereover, and wherein the electronic controls 38 each of which being mounted atop the front side 23 of the body 22. At least one strap button may be installed along a peripheral sidewall 25 of the body 22. In particular guitar models, an output jack may alternatively be installed along the peripheral sidewall 25 of body 22.

The top side 23 of the guitar 20 may further include a pick guard (not shown) attached thereto by pick guard screws (not shown).

The body 22 of an electric guitar 20*a* is most commonly defined as solid and constructed of a wood material. The most common wood materials used for electric guitar body 22 construction include maple, basswood, alder, mahogany, ash, Brazilian rosewood, Indian rosewood, and poplar. Oftentimes, a less expensive wood material, such as ash, is overlapped with a thin panel or layer of another more attractive wood, such as maple, secured to the top side 23 of the less common wood via a suitable adhesive. The body 22 of an electric guitar 20*a* may also be coated with a polyurethane or nitrocellulose lacquer finish.

Preferred plastic or thermoplastic materials for constructing the guitar body may include polyvinyl chloride (PVC), polypropylene, polyolefin, acrylonitrile-butadiene-styrene (ABS), polyethylene, polyurethane, polycarbonate, or blends thereof, and ABS/Nylon blend.

Alternative materials used for guitar body 22 construction may include aluminum alloys and carbon composites.

Figure 3:
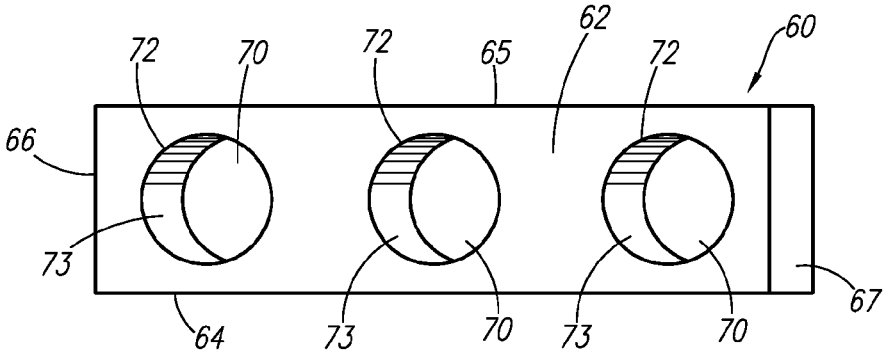
FIG. 3 is a top perspective view of the upper plate of the bracket, in accordance to one embodiment of the present invention.

Referring now to FIGS. 1, 2, and 3, the bracket 10 comprises an upper plate 60, a lower plate 80, and at least one cylinder 100 securably mounted, such as by arc welding, therebetween. The bracket 10 is constructed of a rigid material selected from the group comprising metal, wood, carbon fiber, plastic, thermoplastic, or a metallic-plastic composite. Metal materials include, but are not limited to brass, aluminum, aluminum alloy, titanium, and steel.

Figure 6:
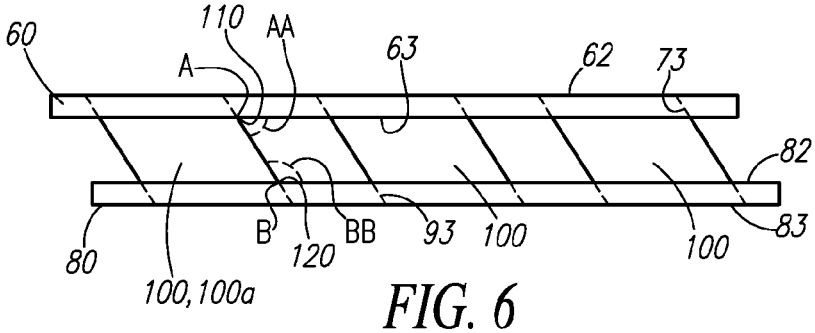
FIG. 6 is a side elevational view of the bracket of FIG. 1.
Figure 9:
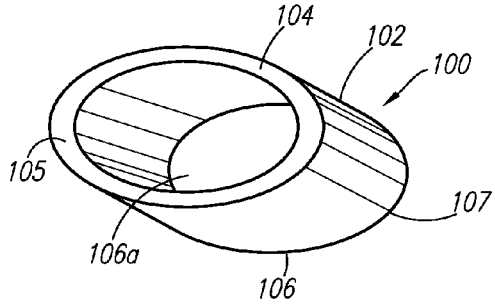
FIG. 9 is a top perspective view of a cylinder, in accordance to one embodiment of the present invention.
Figure 8:
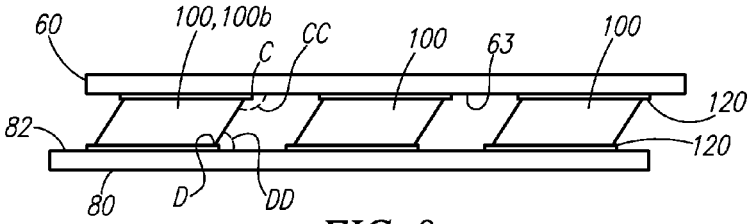
FIG. 8 is a side elevational view of a bracket, in accordance to an alternate embodiment of the present invention.

The upper plate 60 and lower plate 80 are preferably aligned in staggered relation or off-set, as best shown in FIGS. 1, 6, and 8.

The upper plate 60 defines an elongated, planar configuration having at least one hole 70 defined therethrough, wherein the number of holes 70 being equal to the number of cylinders 100. The at least one hole 70 is defined by a boundary 72. The at least one hole 70 may be of varying geometric shapes and sizes.

Referring now more specifically to FIGS. 1, 2, 3, and 6, the upper plate 60 is shown as having a rectangular shape, however, upper plate 60 may be constructed in any one of other various geometric shapes which include, but are not limited to circular, elliptical, or polygonal, e.g., triangular, square, pentagonal, hexagonal, heptagonal, and octagonal. The upper plate 60 is further envisioned to be commercially available in a variety of colors.

In accordance to one embodiment, upper plate 60 comprises an upper wall 62 opposing a lower wall 63, a front side wall 64 opposing a rear side wall 65, and a first end side wall 66 opposing a second end side wall 67. The upper plate 60 further comprises a plurality of holes 70 defined spatially through the upper wall 62 thereof, wherein the holes 70 being three in number. The plurality of holes 70 is defined by a boundary 72.

In particular reference to FIGS. 3 and 6, and in accordance to one embodiment, boundary 72 comprises a continuous, sloped wall 73 defining a circular configuration.

Figure 4:
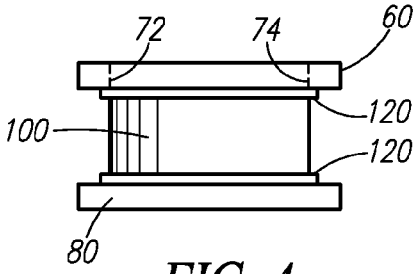
FIG. 4 is an end view of a bracket, in accordance to one embodiment of the present invention.

In particular reference to FIG. 4, and in accordance to another embodiment, boundary 72 comprises a vertically oriented, continuous wall 74 defining a circular configuration.

The plurality of holes 70 may be formed of a shape selected from a variety of geometric shapes and sizes. The plurality of holes 70 may further define varied diameter measures.

Figure 5:
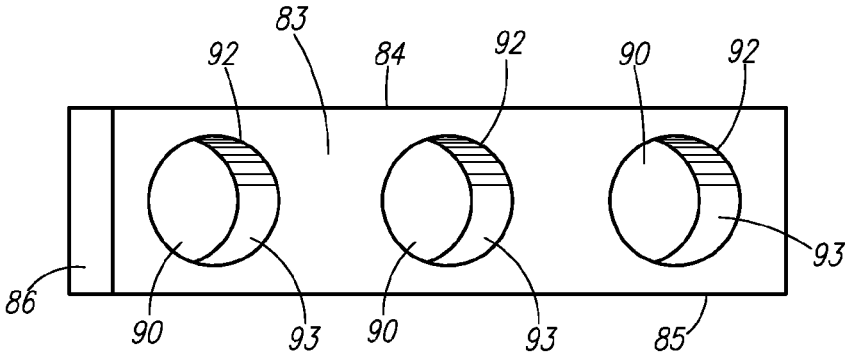
FIG. 5 is a bottom perspective view of the lower plate of the bracket, in accordance to one embodiment of the present invention.

Referring now to FIGS. 1, 2, and 5, the lower plate 80 defines an elongated, planar configuration having at least one hole 90 defined therethrough, wherein the number of holes 90 being equal to the number of cylinders 100. The at least one hole 90 is defined by a boundary 92. The at least one hole 90 may be of varying geometric shapes and sizes.

Referring now more specifically to FIGS. 1, 2, and 6, the lower plate 80 is shown as having a rectangular shape, however, lower plate 80 may be constructed in any one of other various geometric shapes which include, but are not limited to circular, elliptical, or polygonal, e.g., triangular, square, pentagonal, hexagonal, heptagonal, and octagonal. The lower plate 80 is further envisioned to be commercially available in a variety of colors.

In accordance to one embodiment, lower plate 80 comprises an upper wall 82 opposing a lower wall 83, a front side wall 84 opposing a rear side wall 85, and a first end side wall 86 opposing a second end side wall 87. The lower plate 80 further comprises a plurality of holes 90 defined spatially through the upper wall 82 thereof, wherein the holes 90 being three in number. The plurality of holes 90 is defined by a boundary 92.

In particular reference to FIGS. 5 and 6, and in accordance to one embodiment, boundary 92 comprises a continuous, sloped wall 93 defining a circular configuration.

Figure 7:
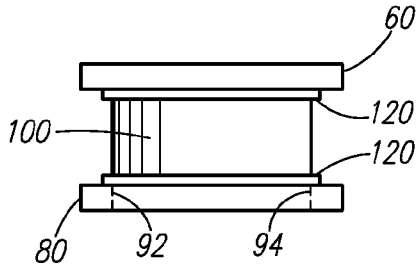
FIG. 7 is an end view of a bracket, in accordance to an alternate embodiment of the present invention.

In particular reference to FIG. 7, and in accordance to another embodiment, boundary 92 comprises a vertically oriented, continuous wall 94 defining a circular configuration.

The plurality of holes 90 may be formed of a shape selected from a variety of geometric shapes and sizes. The plurality of holes 90 may further define varied diameter measures.

The holes 70 and 90 of upper plate 60 and lower plate 80, respectively, in FIGS. 1, 2, 3, 4, and 5, and the cylinders 100 of the bracket 10 in FIGS. 1, 2, 4, and 6-8 are each shown as having a circular shape, however, the holes 70 and 90 and the cylinders 100 may each be constructed in any one of other various corresponding geometric shapes and sizes which include, but are not limited to elliptical, or polygonal, e.g., triangular, square, rectangular, pentagonal, hexagonal, heptagonal, and octagonal. For purposes of this disclosure, "corresponding geometric shapes" is intended to mean the selected shape and size for holes 70 and 90 of upper plate 60 and lower plate 80, respectively, corresponds to the selected shape and size for cylinders 100, and vice-versa. The cylinders 100 of a plurality of cylinders 100 may each comprise a height measure differing from one another. For example, a bracket 10 comprising three cylinders 100, wherein one of the cylinders measures 3 cm in height, the second cylinder 100 measures 4 cm in height, and the third cylinder measures 5 cm in height. The cylinders 100 are further envisioned to be commercially available in a variety of colors.

Referring now to FIGS. 1, 2 and 6, 9, and 10, the cylinders 100 each comprise a hollow body 102 having an open upper end 104 in direct, fluid communication with an open lower end 106, thus forming an open interior 106*a*. The open upper end 104 defines a continuous upper edge 105 and the open lower end 106 defines a continuous lower edge 107. The cylinders 100, in an embodiment not shown, may also be defined as solid.

Figure 10:
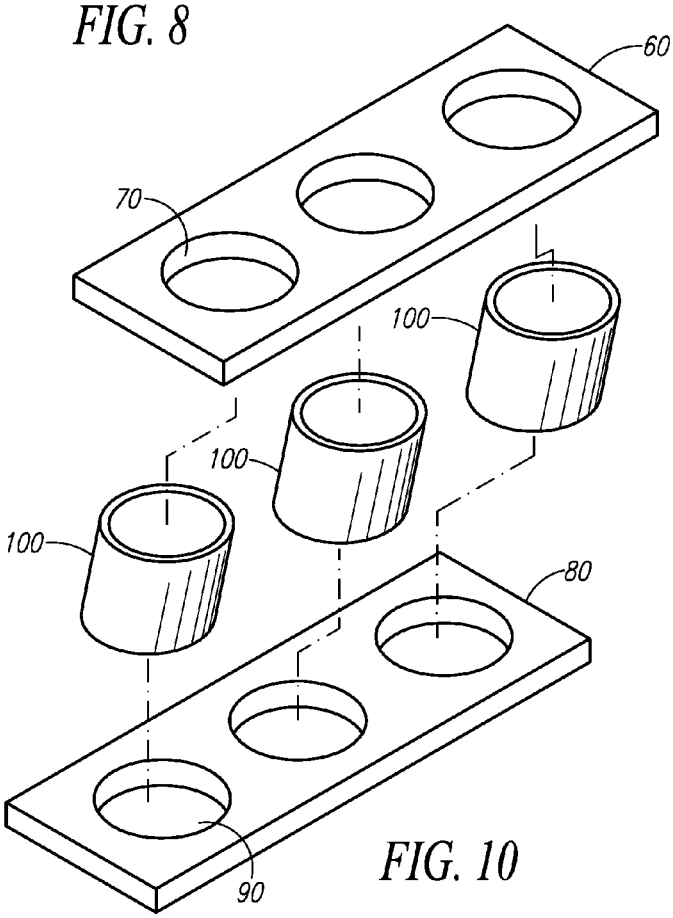
FIG. 10 is an exploded perspective view of a bracket, in accordance to one embodiment of the present invention.

The continuous upper edge 105 of cylinder 100 engages the lower wall 63 of upper plate 60 in a flush manner and is linearly aligned with a hole 70 thereof. The continuous lower edge 107 of cylinder 100 engages the upper wall 82 of lower plate 80 in a flush manner and is linearly aligned with a corresponding, respective hole 90 of a series of holes 90 defined through the lower plate 80. To illustrate properly aligned mounting by cylinders 100 with corresponding holes 70 and 90 of respective plates 60 and 80, FIG. 10 illustrates a bracket 10 in accordance to one embodiment of the present invention, shown in an exploded perspective view. Once the cylinders 100 are properly aligned and positioned between the upper and lower plate 60 and 80 as described hereinabove, the cylinders 100 are securely mounted, such by welding, therebetween.

In reference to FIGS. 4, and 6-8, and more specifically to FIG. 6, the upper end 104 of cylinder 100 joins the upper plate 60 at interface 110, forming angle AA, and the lower end 106 of cylinder joins the lower plate 80 at interface 120, forming angle BB, wherein angle AA and angle BB being supplementary angles. By way of example, in reference to FIG. 6, interface 110 is shown therein as having a vertex A and interface 120 is shown as having a vertex B. Where the lower wall 63 is defined as an X-axis and the external sidewall of cylinder 100*a* is defined as a Y-axis, the X-axis and the Y-axis meet at vertex A, thereby forming an angle measuring 60° (angle AA). Further, where the upper wall 82 is defined as an X-axis and the external sidewall of said cylinder 100*a* is defined as a Y-axis, the X-axis and the Y-axis thereof meet at vertex B, thereby forming an angle measuring 120° (angle BB).

By way of further example, in reference to FIG. 8, interface 110 is shown therein as having a vertex C and interface 120 is shown as having a vertex D. Where the lower wall 63 is defined as an X-axis and the external sidewall of cylinder 100*b* is defined as a Y-axis, the X-axis and the Y-axis meet at vertex C, thereby forming an angle measuring 120° (angle CC). Further, where the upper wall 82 is defined as an X-axis and the external sidewall of said cylinder 100*b* is defined as a Y-axis, the X-axis and the Y-axis thereof meet at vertex D, thereby forming an angle measuring 60° (angle DD).

Referring now to FIGS. 4, and 7-8, a gasket 120 may be disposed between the open upper end 104 of each cylinder 100 and the lower wall 63 of upper plate 60, and between the open lower end 106 of each cylinder 100 and the upper wall 82 of lower plate 80.

Figure 11:
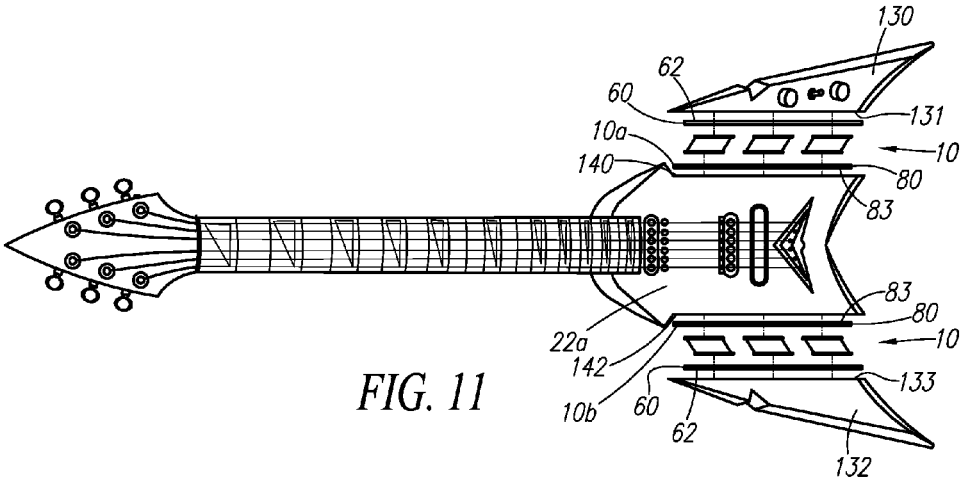
FIG. 11 is an exploded perspective view of a pair of brackets and a guitar, in accordance to one embodiment of the present invention.

Referring now to FIGS. 1A, 1B, 1C, and FIGS. 11-11A, in accordance to one embodiment of the present invention, in order to mount at least one bracket 10, preferably a pair of brackets 10, to the body 22 of a guitar 20, a first posterior portion 130 and/or a second posterior portion 132 of the body 22 is separated, such as by sawing, therefrom, leaving the body 22 with a central portion 22*a* flanked by a first vertical end wall 140 and a second vertical end wall 142. The first posterior portion 130 and/or second posterior portion 132 are mounted via a bracket 10 or a respective pair of brackets 10 to the central portion 22*a* of body 22 via a mounting assembly 160. FIG. 11 illustrates an exemplary embodiment depicting the mounting of the first posterior portion 130 and a second posterior portion 132 to the central portion 22*a* of body 22. The central portion 22*a* is adapted to provide a pair of cam receiving slots 170, 172. The first vertical end wall 140 includes a pair of pins 180 extending therefrom for engaging a respective pair of pin receiving apertures 182 defined through the lower plate 80 of the first bracket 10*a* of the pair of brackets 10.

The second vertical wall 142 includes a pair of pins 180*a* extending therefrom for engaging a respective pair of pin receiving apertures 182*a* defined through the lower plate 80 of the second bracket 10*b* of the pair of brackets 10.

The inner vertical wall 131 of the first posterior portion 130 includes a pair of pins 184 extending therefrom for engaging a respective pair of pin receiving apertures 186 defined through the upper plate 60 of the first bracket 10*a* of the pair of brackets 10.

The inner vertical wall 133 of the second posterior portion 132 includes a pair of pins 184*a* extending therefrom for engaging a respective pair of pin receiving apertures 186*a* defined through the upper plate 60 of the second bracket 10*b* of the pair of brackets 10.

The mounting assembly 160 comprises at least one cam 162 and at least one dowel 164. A first dowel 164 is suitably secured to the inner vertical wall 131 of the first posterior portion 130 so as to extend perpendicularly therefrom. A second dowel 165 is suitably secured to the inner vertical wall 133 of the second posterior portion 132 so as to extend perpendicularly therefrom. The dowels 164 and 165 are positioned so as to engage the open interior 106*a* of a respective cylinder 100 when mounting at least one bracket 10, preferably a pair of brackets 10, to the body 22 of a guitar 20. The central portion 22*a* of body 22 includes a first dowel receiving hole 168 defined perpendicularly through first vertical end wall 140 and being in fluid communication with the first cam receiving slot 170, and a second dowel receiving hole 169 defined perpendicularly through second vertical end wall 142 and being in fluid communication with the second cam receiving slot 172.

The lower plate 80 of one bracket 10*a* of a pair of brackets 10 is aligned flush with the first vertical end wall 140 in a manner so as to allow the pair of pin receiving apertures 182 to receive the pair of pins 180 respectively. The inner vertical wall 131 of the first posterior portion 130 is aligned with the upper plate 60 of the one bracket 10*a* in a manner so as to allow the first dowel 164 to be inserted through the open interior 106*a* of a cylinder 100 of bracket 10*a* and engage the first dowel receiving hole 168. The first cam 162 is placed into the first cam receiving slot 170 over the first dowel 164 and first cam 162 is turned to secure the first posterior portion 130 and one bracket 10*a* to the central portion 22*a* of body 22.

The lower plate 80 of the second bracket 10*b* of the pair of brackets 10 is aligned flush with the second vertical end wall 142 in a manner so as to allow the pair of pin receiving apertures 182*a* to receive the pair of pins 180*a* respectively. The inner vertical wall 133 of the second posterior portion 132 is aligned with the upper plate 60 of the second bracket 10*b* in a manner so as to allow the second dowel 165 to be inserted through the open interior 106*a* of a cylinder 100 of bracket 10*b* and engage the second dowel receiving hole 169. The second cam 163 is placed into the second cam receiving slot 172 over the second dowel 165 and second cam 163 is turned to secure the second posterior portion 132 and second bracket 10*b* to the central portion 22*a* of body 22.

Figure 11A:
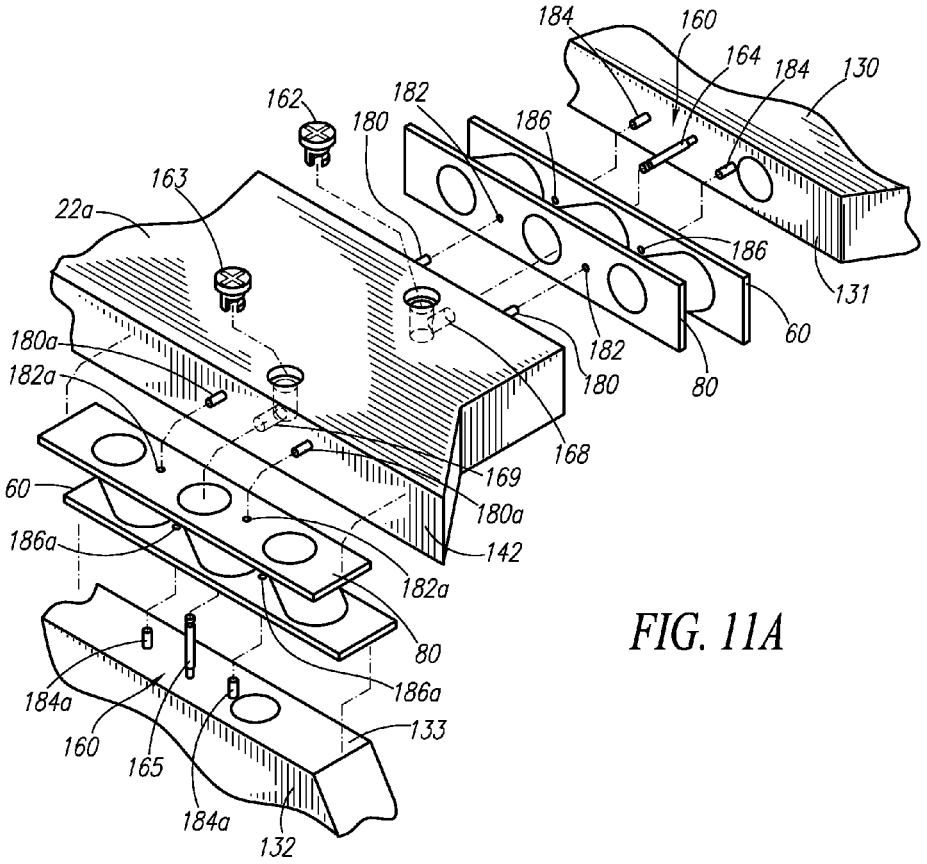
FIG. 11A is a zoom exploded perspective view of FIG. 11 illustrating the mounting assembly, in accordance to one embodiment of the present invention.
Figure 12:
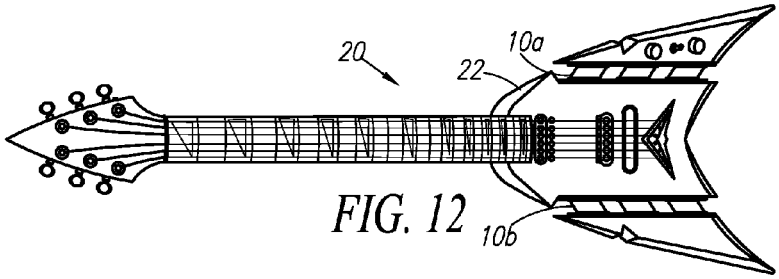
FIG. 12 is a top plan view of a guitar shown mounted with a pair of brackets, in accordance to one embodiment of the present invention.
Figure 13:
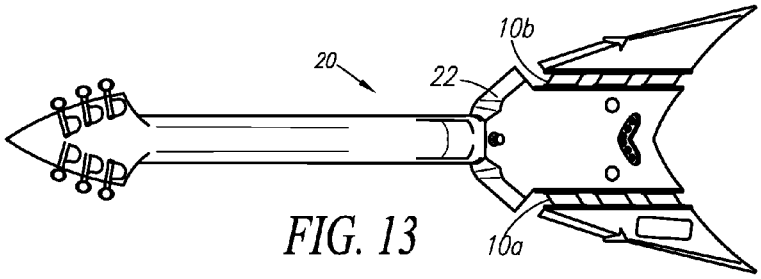
FIG. 13 is a bottom plan view of the guitar of FIG. 12.

Although the cams 162, 163 can be configured such that they can be turned with a screwdriver as is depicted in FIG. 11A, the cams 162, 163 in an embodiment not shown, can also be configured to be turned with an allen wrench, or include an extension to facilitate hand-tightening.

While the lower plate 80 of each respective bracket 10*a*, 10*b* was described hereinabove as being mounted against central portion 22*a* of body 22, it is envisioned, in accordance to user desire or preference, upper plate 60 of each respective bracket 10*a*, 10*b* may be alternatively mounted against central portion 22*a* of body 22, and lower plate 80 of each respective bracket 10*a*, 10*b* may be mounted to first posterior portion 130 and second posterior portion 132, respectively.

Figure 14:
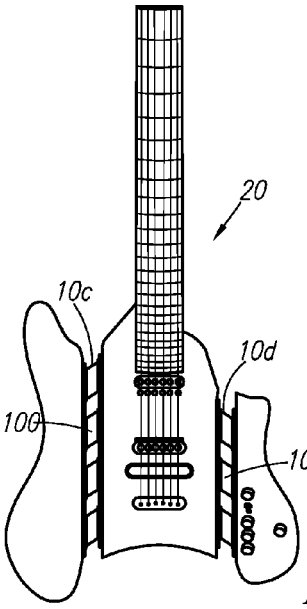
FIG. 14 is a partial top elevational view of a guitar mounted with a pair of brackets, in accordance to an alternate embodiment of the present invention.

It is further envisioned that a pair of brackets 10*c* and 10*d* comprising an unequal number of cylinders 100 may be utilized for mounting to a guitar body 22. FIG. 14 illustrates a guitar 20 mounted with a pair of brackets 10*c* and 10*d* having an unequal number of cylinders 100. Bracket 10*c* is shown as having four cylinders 100 and bracket 10*d* is shown as having three cylinders 100.

Once the brackets 10 are mounted to the body 22 of a selected guitar 20, the brackets 10 facilitate an increase in the velocity of the sound as it is transmitted from the body 22 and through the brackets 10 through which the frequency and vibration of the energy, produced by electric pickups 35, 36, 37 and other electronics utilized, is modified. The brackets 10 function to enhance and amplify tonal effects, in addition to facilitating the production of notes possessing a higher degree of clarity, definition, and sustenance.

It is envisioned the bracket 10 of the present invention may be disposed with a plurality of light-emitting diodes (LED's). The LED's may be arranged and configured to sequentially illuminate in a circular like pattern.

Figure 15:
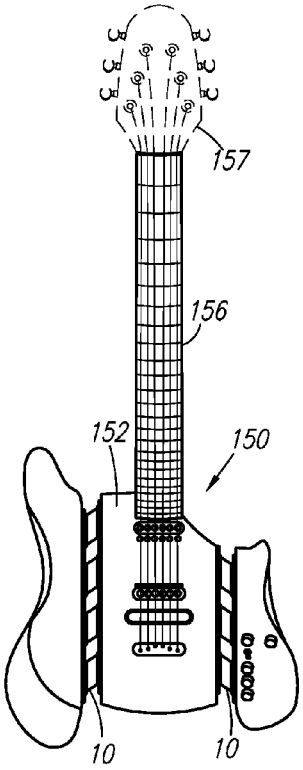
FIG. 15 illustrates another alternate embodiment of the present invention.

Referring now to FIG. 15, an alternate embodiment of the present invention is disclosed, wherein an improved guitar 150 is provided. The guitar 150 comprises a body 152, the body 152 having a neck 156 extending therefrom. The neck 156 may terminate into a head stock 157. At least one bracket 10 is mounted to the body 152 in the manner as previously described hereinabove. Preferably, a pair of brackets 10 is mounted to the body 152 of the guitar 150, as shown in FIG. 15.

Finally, the bracket 10 or a plurality of brackets 10 may be utilized for attaching guitar body 22 parts, components, accessories, and other articles and devices to a selectively-desired guitar 20. For example, in accordance to one embodiment, at least one bracket 10 may be suitably mounted to the head stock 27 a guitar 20, the at least one bracket 10 providing a means for attaching guitar body 22 parts, components, accessories, and other articles and devices to a selectively-desired guitar 20.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A retrofit tone enhancement bracket for a musical instrument, the bracket comprising:

an upper plate;

a lower plate; and at least one cylinder securably mounted between the upper plate and the lower plate, wherein the upper plate defines an elongated, planar configuration having at least one hole defined therethrough, wherein the number of the at least one hole being equal to the number of the at least one cylinder, the at least one hole is defined by a boundary, wherein the at least one hole comprises a shape and size being one of varied geometric shapes and sizes, and wherein the upper plate, the lower plate, and the at least one cylinder are constructed of a rigid material.

2. The bracket of claim 1, wherein the lower plate defines an elongated, planar configuration having at least one hole defined therethrough, wherein the number of the at least one hole being equal to the number of the at least one cylinder, the at least one hole is defined by a boundary, and wherein the at least one hole comprises a shape and size being one of varied geometric shapes and sizes.

3. The bracket of claim 1, wherein the upper plate comprises an upper wall opposing a lower wall, a front side wall opposing a rear side wall, and a first end side wall opposing a second end side wall, and wherein the lower plate comprises an upper wall opposing a lower wall, a front side wall opposing a rear side wall, and a first end side wall opposing a second end side wall.

4. The bracket of claim 3, wherein the at least one cylinder comprises a hollow body having an open upper end in direct, fluid communication with an open lower end, the at least one cylinder having an open interior, the open upper end defines a continuous upper edge, and the open lower end defines a continuous lower edge, the continuous upper edge engages the lower wall of the upper plate in a flush manner and is linearly aligned with at least one hole defined through the upper plate so as to define a first mounting position, the at least one cylinder is mounted at the first mounting position, and wherein the continuous lower edge of the at least one cylinder engages the upper wall of the lower plate in a flush manner and is linearly aligned with at least one hole defined mounted to the at least one cylinder in a manner such that the upper plate and the lower plate are oriented in a staggered or off-set relation.

5. The bracket of claim 4, wherein the at least one hole and of each the upper plate and the lower plate defines a geometric shape and size which corresponds to a geometric shape and size defining the at least one cylinder.

6. The bracket of claim 4, wherein the, the open upper end of the at least one cylinder joins the upper plate at a first interface forming a first angle, and the open lower end of the at least one cylinder joins the lower plate at a second interface forming a second angle, wherein the first angle and the second angle being supplementary angles.

7. The bracket of claim 1, further comprising a mounting assembly for mounting the bracket to the musical instrument.

8. The bracket of claim 7, wherein the mounting assembly comprises:

at least one cam; and at least one dowel.

9. The bracket of claim 4, wherein the upper plate and the lower plate are aligned and at least one cylinder, the at least one hole of the upper plate is defined by a boundary, the at least one hole of the upper plate comprises a shape and size being one of varied geometric shapes and sizes, and wherein the lower plate defines an elongated, planar configuration having at least one hole defined therethrough, wherein the number of the at least one hole of the lower plate being equal to the number of the at least one cylinder, the at least one hole of the lower plate is defined by a boundary, and wherein the at least one hole of the lower plate comprises a shape and size being one of varied geometric shapes and sizes.

10. The bracket of claim 7, wherein the bracket is mounted to the musical instrument via the mounting assembly, the bracket accelerates transmission of vibrational energy through the musical instrument, thus increasing a velocity of sound produced by the musical instrument, and thereby enhancing and improving tonal effects thereof and allowing the musical instrument to produce notes possessing a higher degree of clarity, definition, and sustenance.

11. The bracket of claim 1, wherein the at least one cylinder is solid.

12. A retrofit tone enhancement assembly for a musical instrument, the assembly comprising:

a plurality of brackets, the plurality of brackets each comprising:

an upper plate;

a lower plate; and at least one cylinder securably mounted between the upper plate and the lower plate, wherein the upper plate defines an elongated, planar configuration having at least one hole defined therethrough, wherein the number of the at least one hole being equal to the number of the through the lower plate so as to define a second mounting position, the at least one cylinder is mounted at the second mounting position.

13. The assembly of claim 12, wherein the at least one cylinder is securably mounted between the upper plate and the lower plate in a generally upright or sloped orientation.

14. A musical instrument comprising:

a guitar, the guitar comprising:

a body; and a mounting assembly; and at least one bracket, the at least one bracket is mounted to the body of the guitar via the mounting assembly, and wherein the at least one bracket comprising:

an upper plate;

a lower plate; and at least one cylinder securably mounted between the upper plate and the lower plate.

* * * * *